US006408527B1

(12) United States Patent
Chubb

(10) Patent No.: US 6,408,527 B1
(45) Date of Patent: Jun. 25, 2002

(54) SCORING TOOL

(75) Inventor: Arthur Chubb, Romulus, MI (US)

(73) Assignee: Tapco International Corporation, Plymouth, MI (US)

( * ) Notice: Subject to any disclaimer, the term of this patent is extended or adjusted under 35 U.S.C. 154(b) by 0 days.

(21) Appl. No.: 09/132,583

(22) Filed: Aug. 11, 1998

(51) Int. Cl.[7] ..... B31B 1/25

(52) U.S. Cl. ..... 33/42; 33/24.3; 33/33.3; 33/44; 83/51; 83/885

(58) Field of Search ..... 33/42, 44, 18.1, 33/20.1, 23.01, 23.02, 23.05, 24.1, 24.3, 32.1, 32.2, 32.3, 32.7, 41.4, 41.1; 72/294; 83/885, 51, 886; 225/96.5

(56) References Cited

U.S. PATENT DOCUMENTS 1,150,860 A * 8/1915 Graham ..... 33/41.3
2,529,210 A * 11/1950 Butler ..... 33/44
3,138,981 A * 6/1964 Werthman ..... 83/51
3,304,613 A * 2/1967 Shawhan ..... 33/32.2
3,800,639 A * 4/1974 Restel ..... 33/32.3
3,918,162 A * 11/1975 Houle ..... 33/41.1
5,582,053 A 12/1996 Chubb et al.

FOREIGN PATENT DOCUMENTS

SE 65190 * 12/1926 ..... 33/44

OTHER PUBLICATIONS

Popular Mechanics, " Adjusting Wheel on Marking Gauge Permits Close Setting", p. 133, Mar. 1945.*

* cited by examiner

*Primary Examiner*—Andrew H. Hirshfeld
(74) *Attorney, Agent, or Firm*—Howard & Howard

(57) ABSTRACT

A scoring tool that is especially useful for scoring relatively flat and rigid materials, such as siding materials that are used as exterior trim on buildings, includes two scoring members that engage opposite sides of the sheet of material to provide a straight score line along the material. The scoring members are supported on mounting members that are adjustably moveable relative to a body portion. The body portion includes a groove that receives an edge of the material as the tool is moved along the length of the material. The scoring members engage opposite sides of the material to provide a straight score line that then provides the ability to manually remove the desired portion of the material.

15 Claims, 3 Drawing Sheets

SCORING TOOL

BACKGROUND OF THE INVENTION

This invention generally relates to a device for scoring a line along a relatively rigid and flat piece of material, such as exterior siding or trim, so that the material can be broken along the score line.

A variety of materials are available for finishing off the exterior of a building to provide trim around the frame of windows and doors on a house, for example. A very commonly used material for this purpose is aluminum. The aluminum typically comes in a coil having a set thickness and width. The individual who is putting the siding onto the building unrolls a desired length of the material from the coil and then trims it and bends it according to the needs of a particular situation.

There are a variety of tools available to assist in cutting and bending the trim material. For example, U.S. Pat. No. 5,582,053, which is commonly owned with this application, discloses a cutting tool that is useful in combination with a bending brake for selectively cutting the aluminum trim material into desired widths. Although the device shown in that patent represents a substantial improvement over the prior art, there are times when an individual may not desire to cut the material in the manner provided by that device.

For example, in some instances, a very long piece of material is required. Using the device of that patent to cut the material typically results in at least one end of the material contacting the ground surface as a cut is being made. Under some circumstances this may be undesirable, for example, where an individual is working on a muddy surface and does not desire to allow the trim material to become dirty in the mud. Therefore, it is desirable to provide another tool that facilitates cutting off a portion of the trim material so that it has a desired width.

One method of cutting the siding material has been to score a line on one side of the material using a utility knife. This method has proven unsatisfactory and has many shortcomings and drawbacks. First, it is difficult for an individual to accurately score a straight line along an entire length of material. Any deviation from a desired line typically results in wasting at least a portion of the material because it scratches the surface of the finished trim material, which is unsightly if installed on a building. Second, this method is typically used in conjunction with a conventional bending brake, which typically is made from an aluminum material. The utility knife that is used to score the trim material also can cut into or damage the aluminum material on the bending brake. Over time, the performance and integrity of the bending brake may be comprised. Further, it is possible for an individual to injure themselves while attempting to score a line in the trim material using a utility knife.

It is therefore desirable to provide a device that facilitates cutting trim material by providing a score line along an entire length of the material so that the material can be manipulated in a manner that trims it to a desired width without allowing the material to come in contact with a ground surface, for example. This invention provides such a tool and overcomes the shortcomings and drawbacks discussed above.

SUMMARY OF THE INVENTION

In general terms, this invention is a device for scoring a sheet of relatively rigid material, such as aluminum trim, that is used on the exterior of a building. The device of this invention includes a body portion having a groove extending along one side of the body portion. The groove is adapted to receive an edge of the sheet of material that is to be scored. A first mounting member is supported by the body portion and extends away from one side of the body portion. A first scoring member is supported near one end of the first mounting member. A second mounting member is supported by the body portion and spaced from the first mounting member. A second scoring member is supported near an end of the second mounting member such that the first and second scoring members are approximately equally spaced from the body portion and distanced apart by a distance that is slightly less than a thickness of the sheet of material.

In the preferred embodiment, the first and second scoring members are disks that have annular ridges extending radially away from an outer surface of the disk. The annular ridges preferably have a generally V-shaped cross-section with the apex of the V providing a sharp edge that scores the sheet of material on both sides to provide an accurate score line on the sheet of material.

The preferred embodiment includes visible mar kings on the mounting members that provide a visible indication of the width of the material between an edge of the material and the score line. This feature provides the advantage of allowing an individual to accurately score the material to obtain a desired width.

The various features and advantages of this invention will become apparent to those skilled in the art from the following detailed description of the preferred embodiment. The drawings that accompany the detailed description can be briefly described as follows.

DETAILED DESCRIPTION OF THE PREFERRED EMBODIMENT

Figure 1:
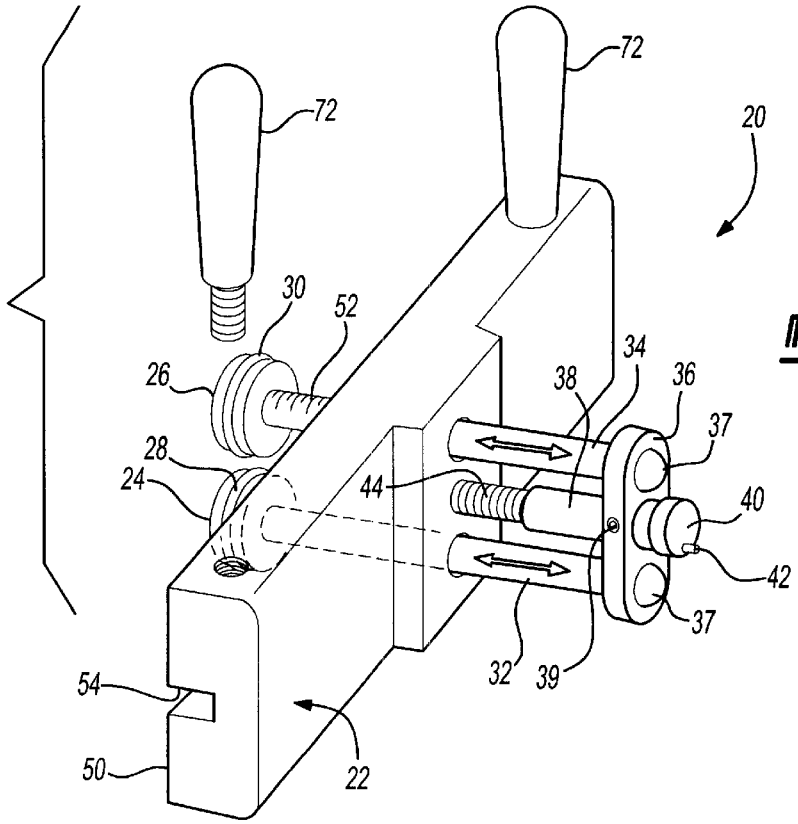
FIG. 1 is a perspective illustration of an embodiment of this invention.
Figure 2:
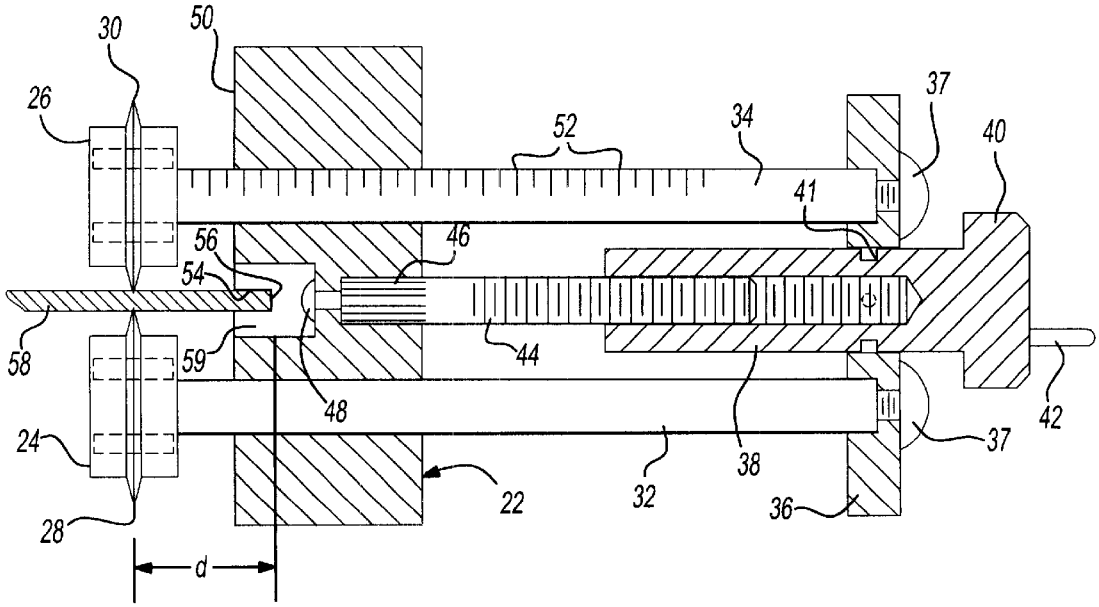
FIG. 2 is a partial cross-sectional view of selected portions of the embodiment of FIG. 1.

FIGS. 1 and 2 illustrate a scoring tool 20 that includes a body portion 22. Two scoring members 24 and 26 preferably are disk-shaped and include radially extending annular ridges 28 and 30, respectively. A pair of mounting members 32 and 34 support the scoring members 24 and 26, respectively, with respect to the body portion 22. The mounting members 32 and 34 preferably are rods that are received through slots or holes through the body portion 22.

The mounting members 32 and 34 preferably support the scoring members 24 and 26 at one end. Ideally, the annular ridges 28 and 30 are maintained in direct alignment with a spacing between them that is less than the thickness of the material to be scored. The opposite end of the mounting members preferably are coupled together with a bracket member 36, which facilitates maintaining the desired alignment of the ridges 28 and 30. The mounting members 32 and 34 are secured to the bracket member 36 using conventional fastening members such as screws 37.

The bracket member 36 also supports a nut member 38 so that the nut member 38 can be rotated relative to the bracket 36 without moving axially. In the illustrated embodiment, a set screw 39 fits within a groove 41 on the nut member to provide the necessary freedom of movement. The nut member 38 preferably is internally threaded as best seen in FIG. 2. The nut member 38 preferably includes a handle portion 40 at one end, which facilitates rotating the nut member 38 relative to the bracket member 36. In the preferred embodiment, an extension lever 42 is provided on the handle portion 40 to provide better leverage in rotating the nut member 38 if desired.

An externally threaded member 44 is supported by the body portion 22. A plurality of ridges 46 and a conventional fastener 48 preferably are included to facilitate mounting the externally threaded member 44 so that it remains fixed relative to the body portion 22. One end of the threaded member 44 is received within the threaded opening on the nut member 38. As can be appreciated from the drawings, as the nut member 38 rotates relative to the bracket member 36, the nut member 38, bracket member 36 and support members 32 and 34 are moved relative to the housing 22 (i.e., right and left according to FIG. 2). This arrangement facilitates moving the scoring members 24 and 26 relative to a first side 50 of the body portion 22 to adjust the position of the scoring members relative to the body portion 22.

At least one of the mounting members preferably includes visible markings 52 that provide a visible indication of the position of the scoring members 24 and 26 relative to the body portion 22. In the illustrated embodiment, the mounting member 34 includes the visible markings 52. It is possible to provide such markings on both of the mounting members 32 and 34 if desired.

The body portion 22 preferably includes a groove 54 that extends along an entire length of the body portion 52. The groove 54 preferably has a generally rectangular cross-section as illustrated. The groove 54 receives one end 56 of a sheet of material 58. As best seen in FIG. 2, the groove 54 preferably comprises an insert 59 that is supported on the housing 22. The insert 59 is useful for making the tool 20 more versatile. For example, a plurality of inserts 59 can be interchanged so that the size of the groove 54 is varied to accommodate materials of different thicknesses. Further, the scoring members 24 and 26 can be replaced with different sized disks or annular ridges to accommodate different materials ridges to accommodate different materials.

The visible markings 52 preferably provide a visible indication of the distance d between the edge 56 of the material 58 and the scoring surface on the ridges 28 and 30, respectively. Therefore, an individual using the tool 20 can accurately position the scoring members 24 and 26 relative to the body portion 22 by manipulating the handle portion 40 on the nut member 38 to achieve a piece of the material 58 having a desired width.

Figure 3:
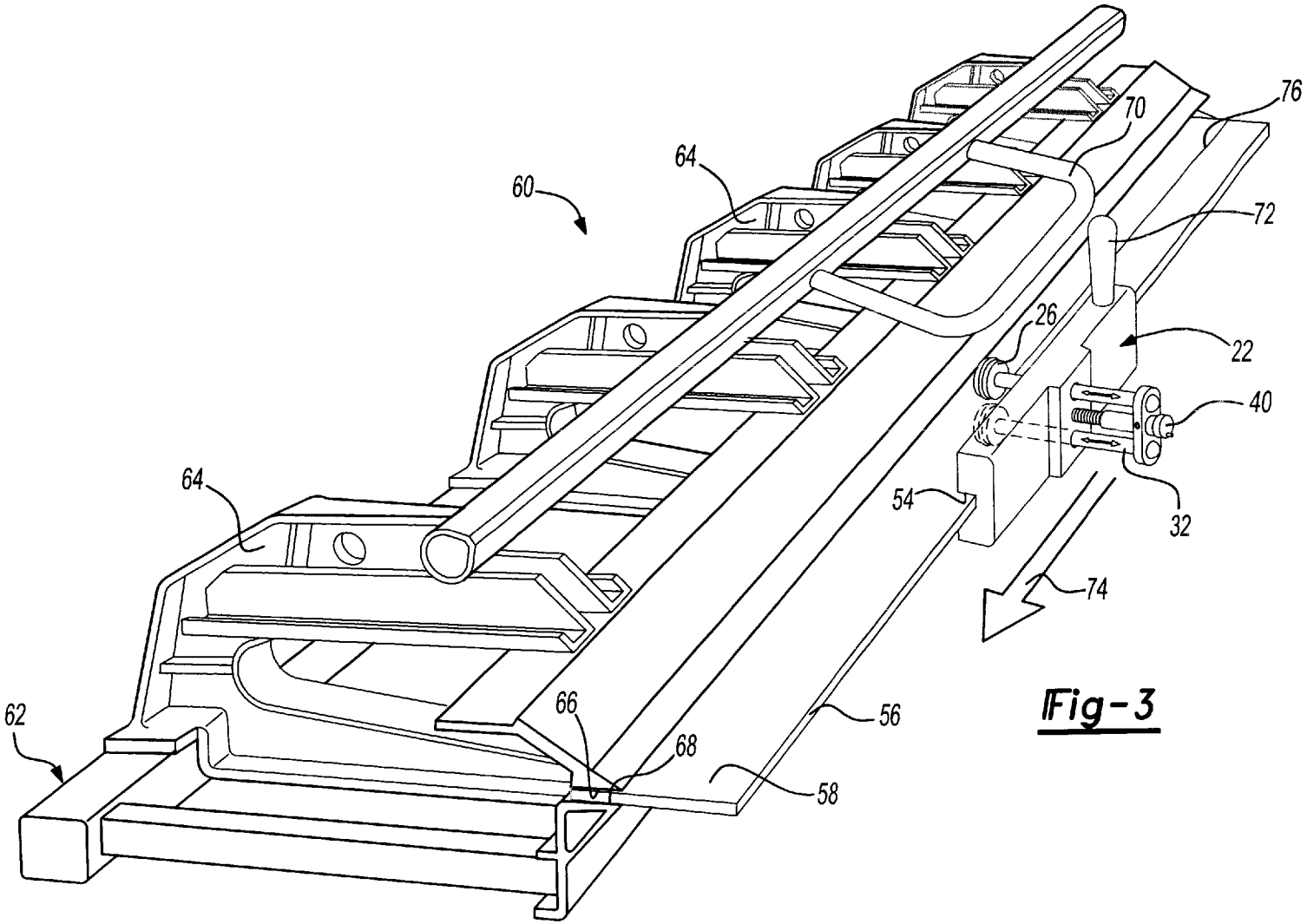
FIG. 3 illustrates the embodiment of FIG. 1 in combination with a bending brake to illustrate one use of a tool designed according to this invention.

FIG. 3 illustrates a preferred use of the tool 20 designed according to this invention. An assembly 60 is shown including a bending brake 62 for holding the piece of material 58. The bending brake 62 can be any conventional bending brake, which typically include a plurality of generally C-shaped members 64 that support a first clamping surface 66 at one end and a second clamping surface 68 near a second end of the C-shaped members. The first and second clamping surfaces are moved relative to each other by manipulating a handle 70, which also provides a locking feature for locking the piece of material 58 between the clamping surfaces 66 and 68. When the piece of material 58 is appropriately positioned within the clamping surfaces of the bending brake 62, the tool 20 can then be used to score the piece of material as desired. A pair of handle members 72 preferably are supported on the body portion 22 so that it is easy to move the tool 20 along the piece of material 58 as indicated by the arrow 74.

In use, the edge 56 of the material is placed within the groove 54 at one end of the material. By grasping the handles 72, the user can then slide the tool 20 along the material 58 as illustrated by the arrow 74, for example. The scoring surfaces on the ridges 28 and 30 engage both sides of the sheet of material 58 and create a score line 76 on each side of the material as the tool 20 moves along the material. The scoring members 24 and 26 preferably rotate as the tool 20 is moved along the sheet of material. Once the tool moves across the entire length of the sheet of material 58, an individual can then grasp the portion of the material between the score line 76 and the edge 56 and manipulate that portion and snap it off to separate it from the remainder of the sheet of material 58. Depending on the position of the scoring members 24 and 26 relative to the body portion 22, the width of the material between the score line 76 and the edge 56 can be varied according to the needs of a particular situation.

Figure 4:
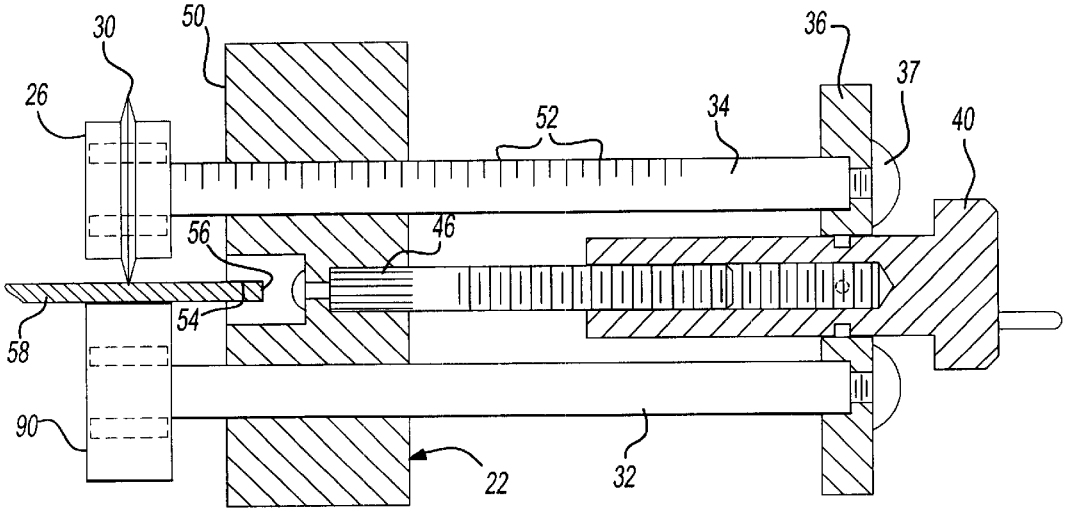
FIG. 4 illustrates a partial cross-sectional view similar to FIG. 2 of an alternate embodiment incorporating a backing member.

FIG. 4 illustrates an alternative embodiment having only one scoring member 26. Instead of a second scoring member, a backing member 90 is provided. The backing member 90 preferably is a disk-shaped member that supports the material 58 on the side opposite the scoring member 26. This embodiment provides a score line 76 on only one side of the material 58, which may be desirable in some instances. Otherwise, the embodiment of FIG. 4 operates identically to that described above.

The preceding description is exemplary rather than limiting in nature. Variations and modifications to the disclosed embodiment are possible that do not depart from the purview and spirit of this invention. The scope of legal protection for this invention is limited only by the following claims.

What is claimed is:

1. A scoring tool for scoring a sheet of substantially rigid material having a thickness, said scoring tool comprising:

a body defining a longitudinal groove in one side thereof, said groove of a predefined width at least equal to the material thickness for receiving an edge of the material, and further wherein said groove is defined by an insert received by said body, said insert readily removable and replaceable with a second insert having a groove of a different width for receiving a material sheet of a corresponding different thickness; and at least two scoring members supported by said body in fixed vertical registration one with the other, said scoring members laterally disposed from said one side of said body, and further wherein at least a first of said scoring members includes a ridge for scoring the material and defining with a second of said scoring members a gap no greater than said width of said groove and substantially aligned therewith.

2. A scoring tool according to claim 1 wherein said second of said scoring members is a backing plate for supporting the material in contact with said first of said scoring members.

3. A scoring tool according to claim 2 wherein said scoring members are discs, said discs being substantially coplanar.

4. A scoring tool according to claim 3 wherein said ridge extends from a periphery of at least a first of said discs, said ridge having an inverted v-shape.

5. A scoring tool according to claim 4 wherein a second of said discs includes a ridge having an inverted v-shape.

6. A scoring tool according to claim 1 wherein each said scoring member is supported from said body by a support bar.

7. A scoring tool according to claim 6 wherein said support bars and said scoring members are adjustable with respect to said body.

8. A scoring tool according to claim 7 wherein said support bars are affixed one to the other at an end opposite from said scoring members.

9. A scoring tool according to claim 8 further including an adjustment member, said adjustment member affixed at one end to said body and to said ends of said support bars opposite from said scoring members, said adjustment member selectively extensible or retractable to selectively adjust said scoring members with respect to said body.

10. A scoring tool according to claim 9 wherein said adjustment member comprises an externally threaded rod and an internally threaded nut, one of said externally threaded rod and said internally threaded nut affixed to said body and a second of said externally threaded rod and said internally threaded nut fixed to said support bars, such that adjustment of said tool results from the rotation of said externally threaded rod with respect to said internally threaded nut.

11. The scoring tool according to claim 10 wherein said rotation is facilitated by a handle affixed to a rotatable one of said externally threaded rod or internally threaded nut.

12. The scoring tool according to claim 1 wherein said scoring members are replaceable with similar scoring members of different size to define therebetween a gap no greater than said different width of said groove and substantially aligned therewith.

13. A method of scoring a sheet of substantially rigid material having a thickness, said method comprising the steps of:

providing a holding device having opposed clamping surfaces;

clamping the rigid material to be scored between the clamping surfaces in the holding device, the area to be scored extending away from said holding device;

providing a scoring tool wherein the scoring tool includes a body having a insert received by the body, said insert defining a longitudinal groove wherein the insert is readily removable and replaceable with a second insert having a longitudinal groove of a different width for receiving a material sheet of a corresponding different thickness and at least two scoring member supported by and laterally disposed from the body, the scoring members defining a gap therebetween smaller than a thickness of the material and wherein the gap is in substantial alignment with the groove, one of the scoring member having a ridge to produce a scoring mark on the material and the other being a backing plate for maintaining the material in contact with a first of the scoring members;

placing the scoring tool at one end of the clamped material;

inserting the edge of the material in the groove of the scoring tool body;

drawing the scoring tool along the length of the material maintaining the material edge captured within the groove; and removing the scoring tool from the material.

14. The scoring method according to claim 13 wherein the step of providing a scoring tool provides a scoring tool wherein both of the scoring members have ridges to produce scoring marks on both sides of the material.

15. The scoring method according to claim 14 wherein the length of material to be scored is shorter than the length of the holding device and further wherein the step of placing the scoring tool is placing the scoring tool on the material end at an intermediate location between ends of the holding device.

* * * * *